US005664740A

United States Patent [19]

Alderman et al.

[11] Patent Number: 5,664,740

[45] Date of Patent: Sep. 9, 1997

[54] RAISABLE PLATFORM FOR APPARATUS FOR PAYING OUT AN INSULATION SUPPORT SHEET

[75] Inventors: Robert J. Alderman, San Antonio; James E. Taylor, Seguin, both of Tex.

[73] Assignee: Owens-Corning Fiberglas Technology Inc., Summit, Ill.

[21] Appl. No.: 536,722

[22] Filed: Sep. 29, 1995

[51] Int. Cl.[6] ..... E04F 21/00

[52] U.S. Cl. ..... 242/592; 242/598.6; 52/749.12

[58] Field of Search ..... 242/592, 598, 242/598.5, 557; 52/404.5, 407.1, 407.2, 749.12; 182/45

[56] References Cited

U.S. PATENT DOCUMENTS

| | | | |
|---|---|---|---|
| 2,439,681 | 4/1948 | Ankney | 242/557 |
| 3,559,914 | 2/1971 | Alderman | 242/557 |
| 3,969,863 | 7/1976 | Alderman | 52/407.4 |
| 3,992,847 | 11/1976 | Heath | 52/749.12 |
| 4,047,345 | 9/1977 | Alderman | 52/404.1 |
| 4,047,346 | 9/1977 | Alderman | 52/407.4 |
| 4,068,446 | 1/1978 | Brueska | 52/746.11 |
| 4,075,807 | 2/1978 | Alderman | 52/407.4 |
| 4,078,355 | 3/1978 | Clemensen | 242/598.5 |
| 4,147,003 | 4/1979 | Alderman | 52/309.8 |
| 4,222,212 | 9/1980 | Alderman | 52/749.12 |
| 4,967,535 | 11/1990 | Alderman | 52/749.12 |
| 5,491,952 | 2/1996 | Alderman et al. | 242/598.5 |

*Primary Examiner*—John P. Darling

*Attorney, Agent, or Firm*—C. Michael Gegenheimer; Curtis B. Brueske

[57] ABSTRACT

An apparatus for providing a roof structure of the type has a plurality of purlins spaced apart from one another in a parallel arrangement. The space between the vertical portions of adjacent purlins defines an insulation cavity which is generally rectangular in cross-sectional shape. The apparatus includes a carriage movable in a first direction along the length of the purlins for paying out a support sheet for support of insulation material as the carriage travels along the length of the purlins. The apparatus also includes a platform attached to the carriage and extending in the direction opposite the first direction and placed in the insulation cavity. The platform is mounted on the carriage by two pairs of hinges for vertical movement.

20 Claims, 2 Drawing Sheets

RAISABLE PLATFORM FOR APPARATUS FOR PAYING OUT AN INSULATION SUPPORT SHEET

TECHNICAL FIELD

This invention relates to the construction of an insulated metal roof structure for use in commercial and industrial buildings.

BACKGROUND ART

Metal roof structures typically comprise a series of parallel rarer beams extending across the building in one direction and purlin beams parallel to each other mounted on top of the rafters extending in a direction normal to the rafters. The purlins are off enjoined together by support bracing or straps for-extra support. Insulation material in long sheets is placed in the area between purlins. The sheets of insulation material can be laid along the length of the purlins or across the purlins in a direction normal to the purlins. Hard roofing material such as metal decking is then attached on top of the purlins over the insulation material. Because the hard roofing material comes in long sheets and the roofs generally have two sloped sections, it is customary to construct the roof along the width of the sloped section and then proceed along the length of the structure from one end to the other. The workers stand on the previously laid section of roof to construct the next section.

The insulation material must be supported between the purlins, and various methods of support have been used. Mounting straps or wire mesh that are attached to the purlins by forming a lattice have been used. This is referred to as banding. A sheet, typically made of vinyl and acting as a vapor barrier, is then rolled onto the lattice, and insulation material is placed between adjacent purlins and over the sheet. If the installation of the lattice is done from underneath the roof structure, scaffolding or lifting equipment is required.

Some systems dispense with the lattice and use the sheet itself to support the insulation material. The support sheet is draped from the adjacent purlins and the insulation material is placed on top of the support sheet. A carriage is used to aid in the dispensing of the support sheet. The carriage is positioned on top of the purlins and travels the length of the purlins during the roof construction. A roll of the support sheet material is mounted on the carriage and the support sheet is dispensed from the roll and placed on top of the purlins. As the carriage travels the length of the purlins the support sheet is draped across the purlins. However, the support sheet sags between the purlins and results in a small vertical height at the sides of the insulation cavity adjacent to the purlins, and results in a compression of the insulation material in that area. Clips that attach the sides of the support sheet to the purlins have been used to alleviate the problem of the sagging support sheet. However, installation of the dips increases costs and endangers the workers that lean over the edge of the uncompleted roof to attach the dips.

A platform extending from the carriage has been used to support the support sheet prior to the attachment of the hard roofing material. The platform is positioned between adjacent purlins and extends out from the carriage and in the direction towards the previously completed section of roof. The support sheet is dispensed from the carriage and rests on the platform while the insulation is placed on top of the support sheet. The hard roofing material is then attached to the purlins on top of the insulation. The platform, being attached to the carriage, is then moved out from underneath the completed section of roof as the carriage is moved, and the procedure is repeated to complete the roof. Because the purlin support bracing and straps are located between the sides of the purlins, the platform must be positioned near the top of the purlins so that the platform will not be obstructed by the bracing as the carriage moves. Thus, the support sheet is relatively flat across the tops of the purlins and does not hang down into the space between the purlins to fill out the entire insulation cavity. Insulation placed on top of the support sheet is then compressed when the hard roofing material is attached to the purlins.

It would be desirable to have a system for building a roof structure that is inexpensive, safe and simple to construct, and that provides for an insulation support system which enables the full thickness of the insulation material to be used.

DISCLOSURE OF INVENTION

There has now been invented an improved apparatus for providing a roof structure, which dispenses a support sheet for supporting insulation material between purlin roof beams. This apparatus provides for an inexpensive and simple system to construct a roof structure which enables the full thickness of the insulation material to be used. In one particular embodiment the apparatus also provides for a safety platform for fall protection for workers on top of the roof structure.

The present invention comprises an apparatus for use on a roof structure of the type having a plurality of purlins spaced apart from one another in a parallel arrangement. The apparatus includes a carriage movable along a direction along the length of the purlins, with the carriage paying out a support sheet for supporting insulation material as the carriage moves along the length of the purlins. A platform is attached to the carriage and extends in the direction opposite the direction the carriage moves. The platform preferably also has sufficient strength for fall protection for workers on top of the roof structure. The platform is mounted on the carriage in an arrangement which allows for vertical movement to accommodate purlin support mechanisms encountered as the carriage moves along the length of the purlins.

In a specific embodiment of the invention, the platform is mounted on the carriage with hinges having two ends. One end of the hinge is pivotally attached to the carriage and the other end is pivotally attached to the platform. Preferably, two pairs of hinges having equal lengths are used so that the platform will remain horizontal when swung upward to minimize the amount of compression of the insulation material.

In another specific embodiment of the invention, the platform is mounted on the carriage by means of a slotted member having a slot in which a pin is slideably mounted. The slotted member can be attached either to the platform or to the carriage, and the pin can be attached either to the carriage or to the platform, respectively. A spring may also be included to keep the platform in its normal lowered position by exerting downward force on the platform.

BEST MODE FOR CARRYING OUT THE INVENTION

Figure 1:
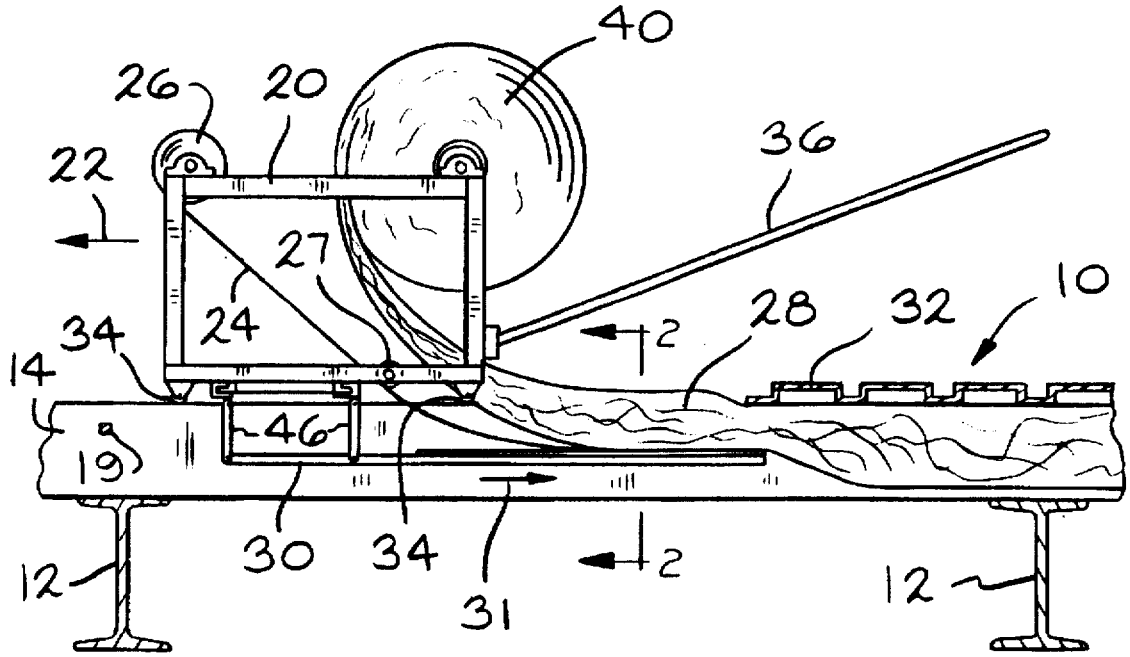
FIG. 1 is a sectional view in elevation of the apparatus of the invention, including a carriage and platform.

There is illustrated in FIG. 1 a building roof structure generally indicated at 10. The roof structure is typically supported by main rarer beams 12 which are positioned parallel to each other. A plurality of purlins 14, spaced apart and arranged parallel to each other, are fastened on top of the rafters in a direction normal to the rafters. The spacing of the purlins is typically 5 feet on centers. Roof structures may also be constructed from bar joists or tresses, and the invention as described herein will work equally well with purlins, bar joists or trusses. The use of the term "purlins" in this specification and claims includes not only traditional purlins, but also bar joists and tresses and other similar structural members.

Figure 2:
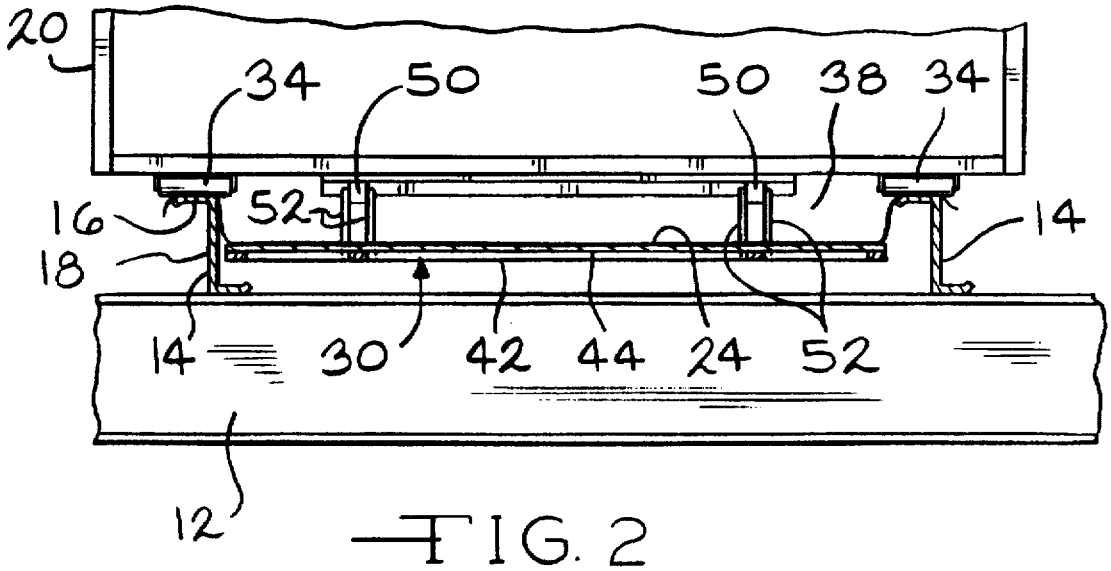
FIG. 2 is a sectional view taken along lines 2—2 of FIG. 1, with the insulation material removed for clarity.
Figure 3:
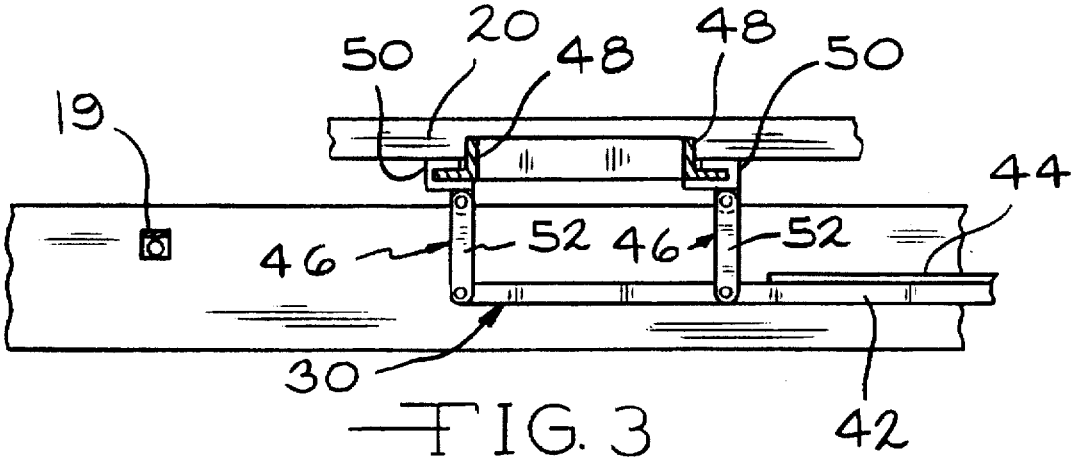
FIG. 3 is a partial elevational view showing the platform mounted on the carriage by hinges.

As shown in FIG. 2, the purlins have a generally Z-shaped cross-section and include a top portion 16 and a vertical portion 18. The purlins are typically joined by purlin support mechanisms 19, such as bracing, and provide for extra support so that the purlins do not tilt or lean over during the lifetime of the roof structure. The support mechanisms can be of any suitable bracing material such as straps, angle iron or U-channels and can be welded, bolted or snapped onto the purlins. The support mechanisms are generally attached to the vertical portion 18 of the purlins near the top portion 16, or attached to the top portion itself.

As shown in FIGS. 1 and 2, a carriage 20 rides on top of the purlins and travels in a first direction 22 along the length of the purlins. As the carriage is moved, a support sheet 24 is dispensed from a roll 26 which is mounted on the carriage. The carriage can be any suitable apparatus for dispensing the support sheet. The support sheet is fed under a roller 27 which is mounted on the carriage and helps spread out the support sheet as the support sheet is dispensed. The support sheet is draped on top of adjacent parallel purlins so that the support sheet depends from the top portions 16 of the purlins. The support sheet supports a layer of insulation material 28 that is placed on top of the support sheet between the adjacent purlins.

A platform 30 is mounted on the carriage and extends in a second direction 31 towards the previously completed section of roof, which is in the opposite direction from the first direction. The platform supports the support sheet as the insulation is placed on top. Long sheets of hard roofing material 32 such as metal decking are then attached to the top portion of the purlins over the support sheet. The attachment of the hard roofing material supports the portion of the support sheet that is directly underneath. The platform, being attached to the carriage, is then moved out from underneath the completed section of roof and the procedure is repeated to complete the entire roof structure.

Although FIGS. 1 and 2 show a carriage as extending between only two purlins, the carriage can be any width up to the width of the roof itself. Multiple support sheet rolls can be mounted on a single carriage in an overlapping fashion so that multiple insulation cavities are insulated at one time. Likewise, multiple carriages can be used and moved in unison as the roof is constructed.

Because the hard roofing material comes in long sheets and the roofs generally have two sloped sections, it is customary to construct the roof along the width of the sloped section and then proceed along the length of the structure from one end to the other. The workers stand on the previously attached hard roofing material to assemble the next section of roof. The carriage travels along the length of the purlins and is moved by the workers as each section of roof is assembled. Preferably, the carriage has rollers 34 that ride on the top portions of the purlins for ease of movement. The carriage can be pushed by a push rod 36 or can be propelled by any other suitable means, such as by a cable hooked to a winch or a motor.

The space between the vertical portions of adjacent purlins defines an insulation cavity 38 having a generally rectangular cross-sectional shape. It is advantageous to fill the insulation cavity with as much insulation material as possible. The greater the amount of insulation material occupying the insulation cavity, the higher the insulating qualities the roof structure will have. The purpose of the support sheet is to support the insulation material in the insulation cavity, but the support sheet can also be used as a vapor barrier and for aesthetic purposes. The support sheet can be of any suitable material for the stated purposes, such as vinyl or foil faced paper. The width of the support sheet is generally such that its edges slightly overhang the adjacent purlins.

The insulation material 28 can be dispensed from a roll 40 mounted on the carriage, and in a direction parallel to the length of the purlins. The insulation material may also be laid across the purlins in a direction normal to their lengths. In this case, the workers unroll a long sheet of insulating material and place it across the purlins in front of the previously completed roof. The hard roofing material is attached to the purlins over the insulation material and the carriage is moved along the purlins as needed. This insulation may be added on top of the insulation material between the purlins for additional thermal protection or as the only source of insulation material.

One of the purposes of the platform 30 is to support the draping support sheet inside the insulation cavity 38 so that when the insulation material is placed on the support sheet, the insulation material will substantially fill the insulation cavity in a uniform rectangular cross-sectional shape. Without the platform, the support sheet would drape from the purlins and have a low vertical height at the sides while having a high vertical height in the middle. If the hard roofing material were to be attached to the purlins, the insulation material would be compressed at its sides. The resultant non-uniform shape would be undesirable because of uneven insulating properties.

Another purpose of the platform is to provide for fall protection for the workers on top of the roof structure. As the roof structure is constructed, the workers are standing on the previously completed section of the roof structure and are in danger of falling while pushing the carriage or handling the roof structures, especially on windy days. Previously, the workers had to be tied off with ropes to prevent injury from falling over the edge of the roof structure. These ropes and tie lines are cumbersome and entangle in the sheets of insulation or hard roofing material. As used in this specification and claims, the term "fall protection" means that the platform will withstand a static load of 400 lbs. This should be adequate to support a worker falling onto the platform.

The platform can be any member suitable for temporarily holding up the support sheet. As shown, the platform is comprised of a skeleton frame 42 upon which a plate 44 is attached. The plate covers the portion of the frame that extends past the carriage. The platform can be constructed from any suitable combination of materials, such as metal, aluminum, or reinforced plastic. Although the platform shown is comprised of a frame and plate, other configurations such as a small grid frame can be used.

Because the platform is positioned in the insulation cavity and between the puffins, the platform must be able to avoid the purlin support mechanisms 19 encountered as the carriage moves in the first direction along the lengths of the purlins. If the platform were fixed with respect to the carriage, the whole carriage would have to be lifted up over the purlin support mechanisms. To avoid this problem, the platform is mounted for vertical movement with respect to the carriage so that when the platform bumps into a support mechanism, the support mechanism can be avoided. The platform mounting can be of any suitable arrangement that allows for vertical movement of the platform to avoid obstructions encountered.

FIGS. 1 through 4 illustrate an embodiment for mounting the platform to the carriage using two pairs of hinges 46 that allow for vertical movement of the platform. A pair of L-shaped beams 48 are attached to the carriage. Two pairs of mounting brackets 50 are fastened to the L-shaped beams. A link member 52 having two ends is pivotally connected to each mounting bracket on one end and pivotally connected to the platform frame on the other end. The links can be attached to the platform and carriage by any suitable means.

Figure 4:
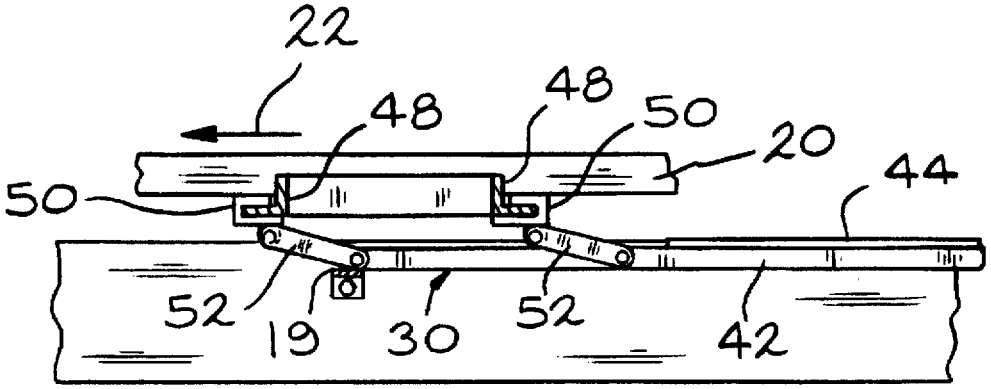
FIG. 4 illustrates the platform mounting of FIG. 3 hinged out from an obstruction.

FIG. 4 illustrates the platform being pivotally moved upward by contact with a support mechanism 19 as the carriage and platform are traveling in the first direction 22. As the platform encounters a support mechanism, the platform is pushed in the second direction toward the previously completed roof by the support mechanism and pivots in an upward direction. When the platform passes over the support mechanism, the platform returns to its normal lowered position. Preferably, two pairs of hinges having equal lengths are used so that the platform will remain horizontal at all times even when swung upward. This will minimize the amount of compression of the insulation material.

Figure 5:
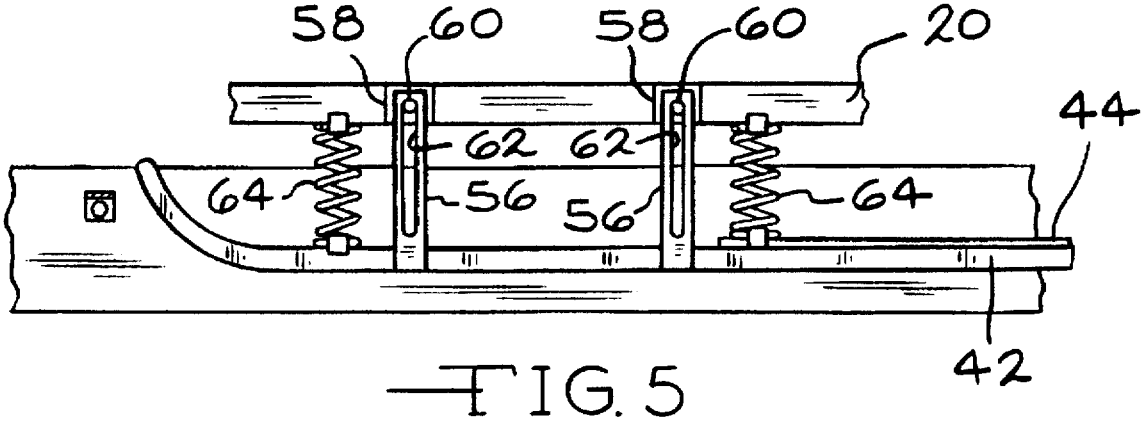
FIG. 5 is another embodiment of the mounting of the platform on the carriage.

FIG. 5 shows another embodiment for mounting the platform on the carriage using two pairs of slotted members 56. Two pairs of brackets 58 having pins 60 are attached to the carriage. Each pin rides in a corresponding slot 62 of the slotted members. A ramp 54 is preferably provided on the forward end of the platform for directing the platform over the purlin support mechanisms. As the platform encounters a purlin support mechanism the platform moves vertically with respect to the carriage and the pin freely allows the slotted member to travel vertically while preventing horizontal or lateral movement. As the platform passes over the support mechanism the platform returns to its normal lowered position by gravity. This mounting arrangement would work equally well with the slotted member attached to the carriage and the bracket attached to the platform.

Springs, such as coil springs 64, may be optionally used to keep the platform in its normal lowered position by exerting downward force on the platform. The springs themselves may also be used for mounting the platform on the carriage, allowing the platform to move vertically by compression of the springs as the platform rides over a support mechanism.

It will be evident from the foregoing that various modifications can be made to this invention. Such, however, are considered as being within the scope of the invention.

INDUSTRIAL APPLICABILITY

The invention can be useful in the construction of roof structures for metal buildings.

We claim:

1. Apparatus for providing a roof structure of the type having a plurality of purlins spaced apart from one another in a parallel arrangement, the purlins having a generally vertical portion, the space between the vertical portions of adjacent purlins defining an insulation cavity which is generally rectangular in cross-sectional shape, comprising;

a. a carriage movable in a first direction along the length of the purlins for paying out a support sheet for support of insulation material as the carriage moves along the length of the purlins so that the support sheet depends from adjacent purlins; and b. a platform attached to the carriage and extending in a second direction, which is in the opposite direction of the first direction, where the platform is mounted for vertical movement with respect to the carriage to avoid purlin support mechanisms encountered as the carriage moves along the length of the purlins.

2. The apparatus of claim 1 in which the platform is placed in the insulation cavity.

3. The apparatus of claim 1 in which the platform is mounted on the carriage by a hinge for vertical movement.

4. The apparatus of claim 3 in which the hinge comprises a link having two ends, one end of the link being pivotally attached to the platform and the other end being pivotally attached to the carriage.

5. The apparatus of claim 3 in which the platform is mounted on the carriage by two pairs of hinges, each hinge comprising a link having two ends, one end of the link being pivotally attached to the platform and the other end being pivotally attached to the carriage.

6. The apparatus of claim 1 in which the platform is mounted on the carriage by a slotted member for vertical movement.

7. The apparatus of claim 6 in which a pin is attached to the platform, the slotted member is attached to the carriage, and the pin is slideably mounted within the slotted member.

8. The apparatus of claim 6 in which a pin is attached to the carriage, the slotted member is attached to the platform, and the pin is slideably mounted within the slotted member.

9. The apparatus of claim 6 in which the platform is attached to the carriage by two pairs of slotted members.

10. The apparatus of claim 1 in which the platform is mounted on the carriage by a spring, the spring being flexible to accommodate purlin support mechanisms encountered as the carriage moves along the length of the purlins.

11. The apparatus of claim 1 in which the platform has a ramp for directing the platform over the purlin support mechanisms as the carriage moves along the length of the purlins.

12. The apparatus of claim 1 in which the platform comprises a frame.

13. The apparatus of claim 1 in which the platform comprises a plate.

14. The apparatus of claim 1 in which the platform comprises a plate attached to a frame.

15. The apparatus of claim 1 in which the platform is sufficient for fall protection.

16. Apparatus for providing a roof structure of the type having a plurality of purlins spaced apart from one another in a parallel arrangement, the purlins having a generally vertical portion, the space between the vertical portions of adjacent purlins defining an insulation cavity that is generally rectangular in cross-sectional shape, comprising;

a. a carriage movable in a first direction along the length of the purlins for paying out a support sheet for support of insulation material as the carriage moves along the length of the purlins so that the support sheet depends from adjacent purlins; and b. a platform, comprised of a frame and a plate, attached to the carriage and extending in a second direction, which is opposite the first direction, and placed in the insulation cavity, the platform being sufficient for fall protection, and the platform being mounted on the carriage by two pairs of hinges for vertical movement with respect to the carriage, and having a ramp to accommodate purlin support mechanisms encountered as the carriage moves along the length of the purlins.

17. The apparatus of claim 16 in which each hinge comprises a link having two ends, one end of the link being attached to the platform and the other end being attached to the carriage.

18. Apparatus for providing a roof structure of the type having a plurality of purlins spaced apart from one another in a parallel arrangement, the purlins having a generally vertical portion, the space between the vertical portions of adjacent purlins defining an insulation cavity that is generally rectangular in cross-sectional shape, comprising;

a. a carriage movable in a first direction along the length of the purlins;

b. a platform, comprised of a frame and a plate, attached to the carriage and extending in a second direction, which is opposite the first direction, the platform being placed in the insulation cavity and mounted on the carriage by two pairs of hinges for vertical movement with respect to the carriage, and having a ramp to accommodate purlin support mechanisms encountered as the carriage moves along the length of the purlins; and c. a support sheet for support of insulation material, where the support sheet is dispensed from the carriage as the carriage moves along the length of the purlins so that the support sheet depends from adjacent purlins, the support sheet being placed over the platform, and the platform supporting the support sheet inside the insulation cavity.

19. The apparatus of claim 18 in which the support sheet supports insulation material placed on the support sheet, and the platform supports the support sheet and insulation material inside the insulation cavity.

20. The apparatus of claim 18 in which the platform is sufficient for fall protection.

* * * * *